United States Patent [19]

Cattaneo

[11] 4,228,939

[45] Oct. 21, 1980

[54] COMBINED SUPPORT AND GUIDE FOR THE MANDREL OF A RESTRAINED MANDREL CONTINUOUS ROLLING MILL

[75] Inventor: Filippo Cattaneo, Milan, Italy

[73] Assignee: Innocenti Santeustacchio S.p.A., Brescia, Italy

[21] Appl. No.: 946,792

[22] Filed: Sep. 28, 1978

[51] Int. Cl.[3] ..... B65H 17/34

[52] U.S. Cl. ..... 226/172; 226/196

[58] Field of Search ..... 226/108, 176, 181, 189–196, 226/199; 269/111, 156, 265, 267

[56] References Cited

U.S. PATENT DOCUMENTS

| | | | |
|---|---|---|---|
| 3,318,005 | 5/1967 | Petersen | 226/196 X |
| 3,527,126 | 9/1970 | Jones, Jr. | 226/176 X |
| 3,627,187 | 12/1971 | Hartkopf | 226/108 |
| 3,856,197 | 12/1974 | Doe et al. | 226/181 |

*Primary Examiner*—Leonard D. Christian

*Attorney, Agent, or Firm*—Birch, Stewart, Kolasch & Birch

[57] ABSTRACT

A combined support and guide for the mandrel of a continuous rolling mill comprises a support structure carrying three levers pivotally mounted on respective pins supported parallel to, equidistant from and equiangularly spaced around the horizontal rolling axis of the mill, each lever carrying a respective roller, freely rotatable thereon about an axis which intersects the lever pivot axis, the roller axes lying in a common vertical plane. One of the levers is connected to the other levers by respective pivotally attached link arms forming parallelogram linkages, such that angular displacements of the one lever under the action of drive means causes simultaneous, similar displacement of the other levers to displace the rollers equally towards the rolling axis to accommodate and support a mandrel between them in coaxial alignment with the rolling axis, the rollers guiding axial movement of the mandrel, there being an adjustable stop which, after separation of the rollers to allow passage therebetween of a forging carried on the mandrel, allows automatic repositioning of the rollers to support the mandrel once again.

3 Claims, 3 Drawing Figures

COMBINED SUPPORT AND GUIDE FOR THE MANDREL OF A RESTRAINED MANDREL CONTINUOUS ROLLING MILL

BACKGROUND TO THE INVENTION

The present invention relates to a combined support and guide for the mandrel of a continuous rolling mill of the type having a restrained mandrel.

In a mill of the aforesaid type, a tubular intermediate forging to be rolled is fitted on to a mandrel for passage through the successive rolling stands. More precisely, a straight mandrel is inserted coaxially into the intermediate forging, which is supported coaxially with the rolling axis upstream of the first stand of the mill, the forging being fitted to the mandrel with a predetermined shrinkage. Subsequently, the mandrel and intermediate forging are moved as a unit through the successive stands of the mill, still on the rolling axis, with a controlled velocity. This unit is stopped when the tip of the mandrel corresponds with the mouth of the cylinders of the last rolling stand, which effects the last rolling operation on the intermediate forging and allows the simultaneous removal of the finished tube from the mandrel. The mandrel is then returned to its original position for insertion into a further intermediate forging to be rolled in the mill.

In order to ensure the proper operation of such a rolling mill to give good results in the finished product, the outer surface of the mandrel is accurately worked mechanically, and is covered with a layer of suitable lubricant. During the movements of the mandrel through the rolling stands, of the known mills, however, it may, and in fact, frequently does come into contact with, and even bangs against, the rolling cylinders, with consequent removal of the lubricating layer and damage to its outer surface. This is due to the fact that the mandrels are not always perfectly straight, the stands are not always perfectly aligned on the rolling axis, and the velocity of rectilinear movement of the mandrel through the stands is relatively high.

Such damage to the mandrel may result in seizure of a tube being rolled on the mandrel, this problem being accentuated when the aperture of passage through the stands is very small, as is required for the rolling of tubes of small thickness.

The object of the present invention is to provide a combined support and guide for a mandrel during its traverse through the rolling mill, which supports and guides the mandrel to reduce its contact with the rolling cylinders.

SUMMARY OF THE INVENTION

According to the present invention there is provided a combined support and guide for supporting and guiding a mandrel for movement along a horizontal rolling axis of a continuous, restrained-mandrel rolling mill comprising: a support structure; three pivot means supported by said support structure and defining horizontal pivot axes parallel to said rolling axis, said pivot axes being disposed equidistant from and equiangularly spaced with respect to said rolling axis; three levers pivotally mounted one on each said pivot means; three rollers freely rotatably mounted one on each said lever about an axis of rotation which intersects the respective pivot axis of the lever, said axes of rotation of said rollers lying in a common plane perpendicular to said rolling axis, drive means for driving angular displacements of said levers simultaneously about the respective said pivot axes to displace the rollers with respect to said rolling axis by the same amount and in the same sense to accommodate and support a mandrel between them in coaxial alignment with said rolling axis.

BRIEF DESCRIPTION OF THE DRAWINGS

One embodiment of a combined support and guide according to the invention, will now be more particularly described, by way of example with reference to the accompanying drawings in which.

DESCRIPTION OF A PREFERRED EMBODIMENT

Figure 1:
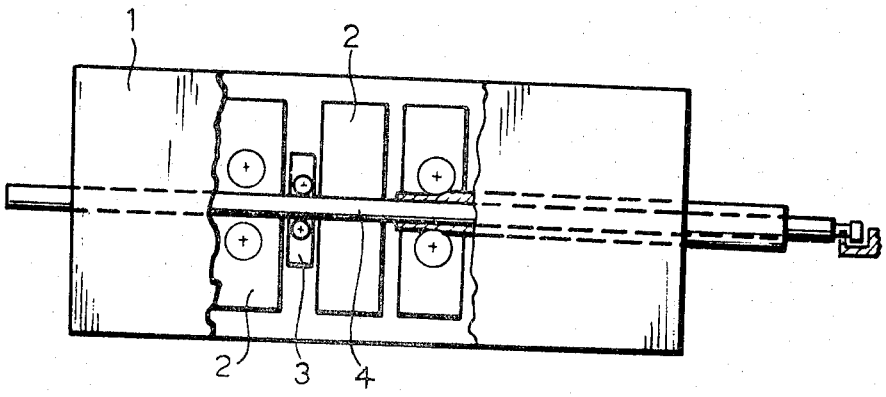
FIG. 1 is a diagrammatic side view of a continuous rolling mill with a restrained mandrel, incorporating a plurality of combined supports and guides for the mandrel according to the invention.

Referring to FIG. 1 of the drawings a restrained-mandrel continuous rolling mill is shown generally indicated 1 and includes a plurality of rolling stands 2, arranged in alignment along a common rolling axis L. In use of the mill 1, a tubular intermediate forging 5 to be rolled is fed through the stands 2 carried on a straight mandrel 4. The mandrel 4 is supported for its rectilinear movement through the mill 1 along the rolling axis L by means of a plurality of combined supports and guides according to the invention, generally indicated 3. Purely by way of example, only one support and guide 3 is shown between a pair of adjacent rolling stands 2 in the continuous rolling mill 1.

Figure 2:
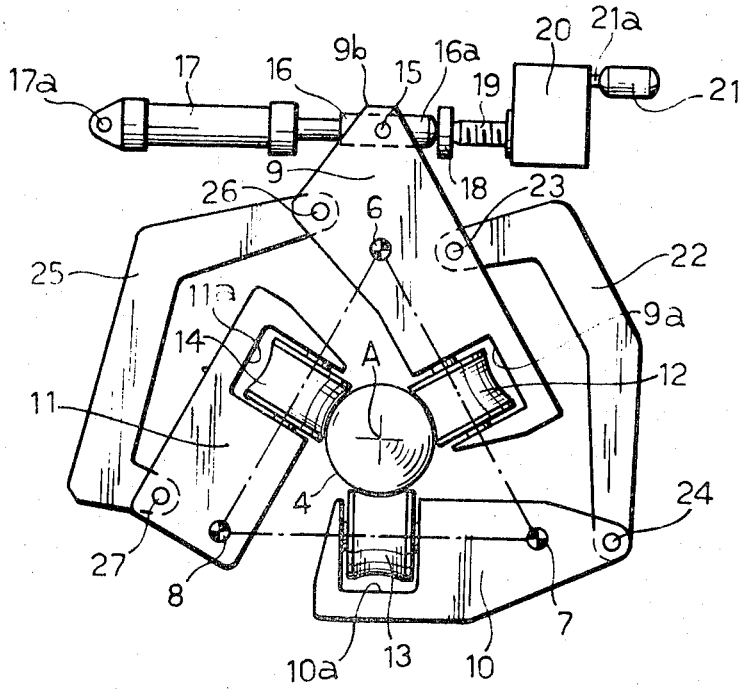
FIGS. 2 and 3 are diagrammatic front elevational views of a stand and guide of FIG. 1 in respective operative positions.

Referring to FIG. 2 of the drawings a support and guide 3 is shown having a support structure 3*a* carrying three pins 6, 7 and 8 which extend horizontally and parallel to an axis A, coincident with the rolling axis L in its position of use in the mill of FIG. 1. The pins 6, 7 and 8 are located symmetrically around the axis A, their centres of cross-section in a vertical plane being equidistant from, and equiangularly spaced with respect to the axis A.

Each of the pins 6, 7, 8 supports a respective lever 9, 10, 11, each of which is pivotally mounted on its respective pin and carries a respective roller 12, 13 14 supported in idling manner for free rotation between faces of respective end portions 9*a*, 10*a*, 11*a* of the levers 9, 10, 11. The axes of rotation of the rollers 12, 13, 14 pass through the axes of the pivot pins of the respective levers on which they are carried and are arranged to lie in a common vertical plane, perpendicular to the axis A. Moreover, the rollers 12, 13 and 14 are identical and are equispaced from the axes of the respective pivot pins of the levers on which they are supported.

The lever 9 is pivotally mounted at its end 9*b* opposite the end 9*a* on a horizontal pivot pin 15 which extends parallel to the axis A and is carried by a shaft 16 of a double-acting oleodynamic actuator 17 which in turn is pivotally mounted on the support structure 3*a*, about a horizontal pivot axis 17*a*, parallel to the axis A.

The free end of the shaft 16 is formed with a hemispherical head 16*a* arranged to cooperate with a planar, vertical wall of a plate-like stop 18 fixed to the free end of a screw-threaded shaft 19. The shaft 19 is connected to one side of a conventional kinematic motion reducer (not illustrated) to be driven to rotate thereby. The motion reducer is housed in a casing 20 supported by the support structure and is connected on its side opposite the shaft 19 to a drive shaft 21*a* of a motor, shown diagrammatically at 21.

The levers 8, 9, 10 are interconnected by two link arms 22, 25 each of which is pivotally mounted at one end on the lever 9 about a respective pivot pin 23, 26 and at the other end on the lever 8 or 10 about a pivot pin 24, 27 respectively, the pins 24, 27 being located at the end of the levers 8, 10 opposite the ends 8*a*, 10*a*. All the pivot pins 23, 24, 26, 27 are located with their axes horizontal and parallel to the axis A. The pins 23, 24 are so positioned that the link arm 22 constitutes, with the pivot pins 6 and 7 of the levers 9 and 10 respectively, a parallelogram linkage articulated externally of the triangle formed by the pins 6, 7, 8.

Similarly, the pivots 26 and 27 are so positioned that the link arm 25 constitutes, with the pivot pins 6 and 8 of the levers 9 and 11 respectively, a further parallelogram linkage aritculated externally of the said triangle.

Each of the rollers 12, 13, 14 carried by the levers 9, 10, 11 has a concavely-curved external rolling surface for cooperating with a mandrel 4.

OPERATION

The operation of the support and guide 3 described above is as follows:

First the distance of the rollers 12, 13 and 14 from the axis A is adjusted according to the external diameter of the mandrel 4 to be supported and guided by the stand during operation of the continuous rolling mill 1. To this end, the mandrel 4 being located between the rollers with the rollers spaced from the mandrel, the oleodynamic actuator 17 and the motor 21 which drives the shaft 19 carrying the plate-like stop 18 are activated simultaneously such that the spherical head 16*a* of the shaft 16 of the actuator remains in constant engagement with the said plate-like stop 18 and the shafts 16 and 19 are displaced to the right, as seen in FIG. 2. This movement results in corresponding rotation of the lever 9 about the pivot pin 15 carried by the shaft 16 to displace the roller 12 towards the mandrel 4. Rotation of the lever 9, because of the geometrical arrangement of the link arms 22, 25 connecting the lever 9 to the levers 10, 11 respectively, also results in a corresponding rotation of these levers 10, 11 in the same sense as the lever 9 and through an equal angle, thus causing simultaneous displacement by the same amount of all three rollers 12, 13, 14, carried on their respective levers, towards the mandrel 4. Displacement of the rollers 12, 13, 14 towards the mandrel 4 is stopped when the rollers contact the surface of the mandrel to support it between them.

The rollers 12, 13, 14 are maintained in contact with the mandrel 4 during the insertion of the mandrel 4 into a tubular intermediate forging which is to be subjected to rolling, the rollers supporting and guiding the mandrel for strictly axial movement during this stage, this movement being possible because of the free rotation of the rollers 12, 13 and 14 on the respective levers.

Figure 3:
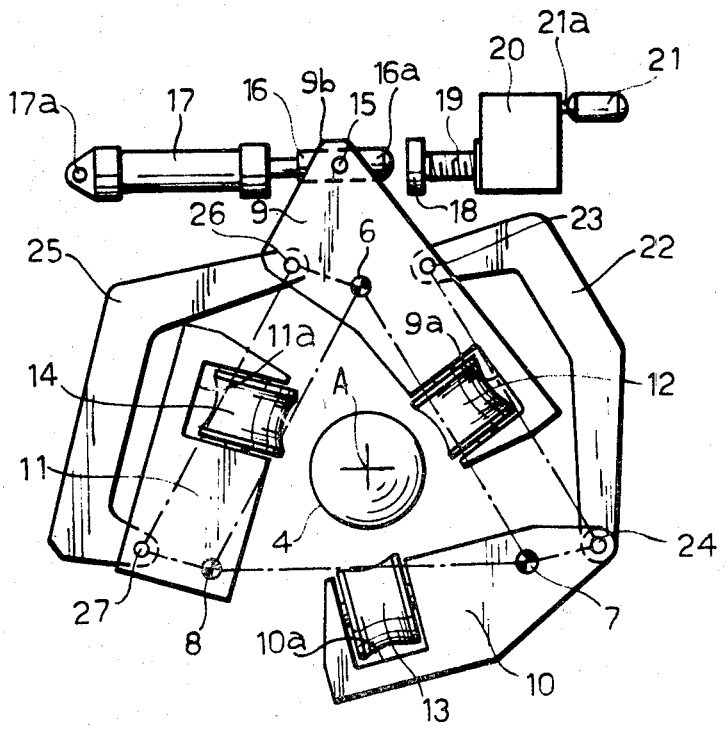

During rolling, the three rollers are maintained in engagement with the mandrel 4 until the intermediate forging being rolled approaches them, but the moment the intermediate forging is immediately adjacent the opening of the passage between the rollers 12, 13 and 14, a signal is sent by conventional devices, to a group (not shown) which controls the operation of the actuator 17. The shaft 16 of the actuator is then recalled into the actuator cylinder, moving to the left, as seen in FIG. 3, and causing anticlockwise rotation of the levers 9, 10, 11 to withdraw the rollers 12, 13, 14 from engagement with the mandrel 4 by reversal of the actions described above, the rollers 12, 13, 14 always moving simultaneously, in the same sense and by the same amount. The opening between the rollers is thus widened to allow the passage of the intermediate forging between the rollers.

As soon as the end of the intermediate forging has passed through the support and guide of the present invention a signal is sent to the said control group which activates the actuator 17 to displace the shaft 16 axially towards the stop 18 which has remained stationary during the above disengagement of the rollers from the mandrel 4. The rollers 12, 13, 14 are thus again displaced towards the mandrel 4 and when the head 16*a* of the shaft 16 abuts the stop 18 the rollers are again in their former position of engagement with the mandrel to support it and guide it during a new stage of rolling of the intermediate forging.

The accurate self-centering of the rollers of the support and guide of the present invention ensures that the portion of the mandrel 4 supported by a particular support and guide 3 is maintained on the rolling axis, at least one of the combined supports and guides preferably being located between each pair of adjacent rolling stands of the continuous rolling mill. The present invention thus provides constant support for the mandrel during the rolling stages, safely avoiding any contact or impact between the mandrel and the rolling cylinders, even when the passage between these cylinders is very limited, as occurs in the rolling of tubes of small thickness.

A further advantage of the present invention is that the combined supports and guides can be used to support mandrels of any diameter suitable for use in the mill. Although the initial positioning of the rollers with respect to the mandrel 4 has been described with the mandrel located between the rollers, in fact the position of the stop 18 may be calibrated for mandrels of different sizes, and controls may be present to position the stop for a particular mandrel before insertion of the latter between the rollers.

What is claimed is:

1. A combined support and guide for supporting and guiding a mandrel for movement along a horizontal rolling axis of a continuous, restrained-mandrel rolling mill comprising:

a support structure, three pivot means supported by said support structure and defining horizontal pivot axes parallel to said rolling axis, said pivot axes being disposed equidistant from and equiangularly spaced with respect to said rolling axis, three levers pivotally mounted one on each said pivot means, three rollers freely rotatably mounted one on each said lever about an axis of rotation which intersects the respective pivot axis of the lever, said axes of rotation of said rollers lying in a common plane perpendicular to said rolling axis, drive means for driving angular displacements of said levers simultaneously about the respective said pivot axes to displace the rollers with respect to said rolling axis by the same amount and in the same sense to accommodate and support a mandrel between them in coaxial alignment with said rolling axis.

2. The combined support and guide of claim 1, wherein said drive means are arranged to act on one lever of said three levers, and wherein said one lever is connected to the other two levers of said three levers by a respective link arm, each of said link arms being pivotally attached at one end to the said one lever and at the other end to a respective one of said other two levers so as to constitute, with the respective pivot means of the levers to which it is attached, a parallelogram linkage.

3. The combined support and guide of claim 2, including an adjustable stop for stopping the angular displacement of said one lever towards said rolling axis under the action of said drive means when the roller of said one lever is in peripheral contact with the outer surface of a mandrel of prefixed diameter, located between the three rollers, coaxial with said rolling axis.

* * * * *